US011160316B2

(12) United States Patent
O'Leary

(10) Patent No.: US 11,160,316 B2
(45) Date of Patent: Nov. 2, 2021

(54) ONE-TIME WEARABLE BRASSIERE FOR SUPPORTING AND LIFTING BREASTS

(71) Applicant: Sasha O'Leary, San Francisco, CA (US)

(72) Inventor: Sasha O'Leary, San Francisco, CA (US)

( * ) Notice: Subject to any disclaimer, the term of this patent is extended or adjusted under 35 U.S.C. 154(b) by 22 days.

(21) Appl. No.: 16/232,640

(22) Filed: Dec. 26, 2018

(65) Prior Publication Data

US 2020/0205486 A1 Jul. 2, 2020

(51) Int. Cl.
*A41C 3/06* (2006.01)
*A41C 3/00* (2006.01)

(52) U.S. Cl.
CPC ..... *A41C 3/065* (2013.01); *A41C 3/0028* (2013.01); *A41B 2300/328* (2013.01); *A41B 2400/38* (2013.01); *A41C 3/0078* (2013.01)

(58) Field of Classification Search
CPC ..... A41C 3/065; A41C 3/0028; A41C 3/0078; A41B 2300/328; A41B 2400/38
USPC ..... 450/39, 81
See application file for complete search history.

(56) References Cited

U.S. PATENT DOCUMENTS 2,508,855 A * 5/1950 Brown ..... B65D 63/1009 428/43
3,276,449 A * 10/1966 Morgan ..... A41C 3/065 450/81
3,434,478 A * 3/1969 Cohen ..... A41C 5/005 450/39
3,934,593 A * 1/1976 Mellinger ..... A41C 3/065 450/56
4,343,313 A * 8/1982 Le Jeune ..... A41C 3/065 450/39
5,263,923 A * 11/1993 Fujimoto ..... A41D 13/0015 602/62
5,458,635 A * 10/1995 Berman ..... A61F 2/52 623/7

(Continued)

*Primary Examiner* — Justin M Jonaitis

(57) ABSTRACT

Disclosed is a one-time wearable brassier for supporting and lifting sagging breast. The one-time wearable brassier includes a first layer, an adhesive layer and a removable second layer. The adhesive layer comprising adhesives adheres the first layer to the breast. The removable second layer covers the adhesive layer. The removable second layer protects the adhesive from dying until the user is ready to apply the first layer along with the adhesive layer to the breast. The first layer is having a pear shaped stretchable woven fabric. The first layer is having a curvy top end, a flat base, a central portion to cover the breast, a curved left bottom edge, a curved right bottom edge, a tapered left side extending from the curved left bottom edge up to the curvy top end, and a right side extending from the curved right bottom edge up to the curvy top end. The length of flat base is greater than the curvy top end. A user lifts the sagging breast to paste the curved left bottom edge beneath left edge of the breast and further pastes the curved right bottom edge beneath right edge of the breast. Further, the user pastes the central portion of the first layer up to center of the breast and then the user stretches the curvy top end of the first layer up to chest such that the central portion covers the breast while maintaining firmness of the breast in upright position.

7 Claims, 7 Drawing Sheets

(56) References Cited

U.S. PATENT DOCUMENTS

| | | | | |
|---|---|---|---|---|
| 6,371,831 | B1 * | 4/2002 | Dodge | A41C 3/065 2/67 |
| D473,641 | S * | 4/2003 | Kali | A41C 3/065 D24/124 |
| 7,001,241 | B2 * | 2/2006 | Gorringe | A61F 13/141 450/37 |
| 7,335,086 | B1 * | 2/2008 | Karon | A41C 3/065 450/1 |
| 9,596,891 | B2 * | 3/2017 | Deal | A41C 3/0007 |
| 10,111,473 | B2 * | 10/2018 | Kratsa | A41C 3/065 |
| 10,299,953 | B2 * | 5/2019 | Bushby | A43B 7/142 |
| 2010/0180359 | A1 * | 7/2010 | Andrews | A41C 3/065 2/69 |

* cited by examiner

ONE-TIME WEARABLE BRASSIERE FOR SUPPORTING AND LIFTING BREASTS

BACKGROUND OF THE INVENTION

1. Field of the Invention

The present invention generally relates to a brassiere, and more particularly relates to a one-time wearable brassiere for supporting and lifting breasts.

2. Description of Related Art

There are bras and other support techniques known in the art for female breast support. However, large breasts are difficult to support. Bras and other clothing supports tend to add significant tension and stress to the back and shoulders. Conventional brassieres provide support to an individual's breasts by holding the individual's breasts in cups that are supported on the individual by straps around the individual's back and/or shoulder straps.

Strapless bras are required to be worn with dresses like tunic, shift, slip, baby-doll, off-shoulder etc. Strapless bras are not comfortable as they start sliding down. Further, the strapless bras do not provide any uplifting of sagging breasts. Furthermore, the lack of effective support for large breasted woman causes significant problems—physical pains, inability to wear certain clothing, inability to participate in certain activities such as athletics, etc.

Various types of adhesive brassiere are also currently available in the market. The user peels of the plastic backing layer to attach the brassier cups to the breast of the user. Generally, adhesives which hold strapless bras in place lose their effectiveness upon exposure to moisture, humidity and turbidity while being worn or during the laundering process. Thus, the adhesive brassiere becomes ineffective in holding the breasts after sometime as they tend to lose the adhesive effectiveness.

Therefore, there is a need of a one-time wearable brassiere for supporting and lifting sagging breasts. Further, the one-time wearable element should be able to stick to the breast for longer duration. Furthermore, the one-time wearable element provides therapeutic effect by improving blood flow in the breast.

SUMMARY OF THE INVENTION

In accordance with teachings of the present invention a one-time wearable brassier for supporting and lifting sagging breast is provided.

An object of the present invention is to provide a one-time wearable brassier for supporting and lifting sagging breast. The one-time wearable brassier includes a first layer, an adhesive layer and a removable second layer. The adhesive layer comprising adhesives adheres the first layer to the breast.

The removable second layer covers the adhesive layer. The removable second layer protects the adhesive from dying until the user is ready to apply the first layer along with the adhesive layer to the breast. The first layer is having a pear shaped stretchable woven fabric. The first layer is having a curvy top end, a flat base, a central portion to cover the breast, a curved left bottom edge, a curved right bottom edge, a tapered left side extending from the curved left bottom edge up to the curvy top end, and a right side extending from the curved right bottom edge up to the curvy top end.

The length of flat base is greater than the curvy top end. A user lifts the sagging breast to paste the curved left bottom edge beneath left edge of the breast and further pastes the curved right bottom edge beneath right edge of the breast. Further, the user pastes the central portion of the first layer up to center of the breast and then the user stretches the curvy top end of the first layer up to chest such that the central portion covers the breast while maintaining firmness of the breast in upright position.

Another object of the present invention is to provide the first layer made of cotton and elastic. Further, the adhesive layer is of acrylic coating. Furthermore, the curved right bottom edge extends beyond the flat base. The user lifts the sag breasts to the center. The curved right bottom edge supports the position of the breasts in the center.

Figure 1A:
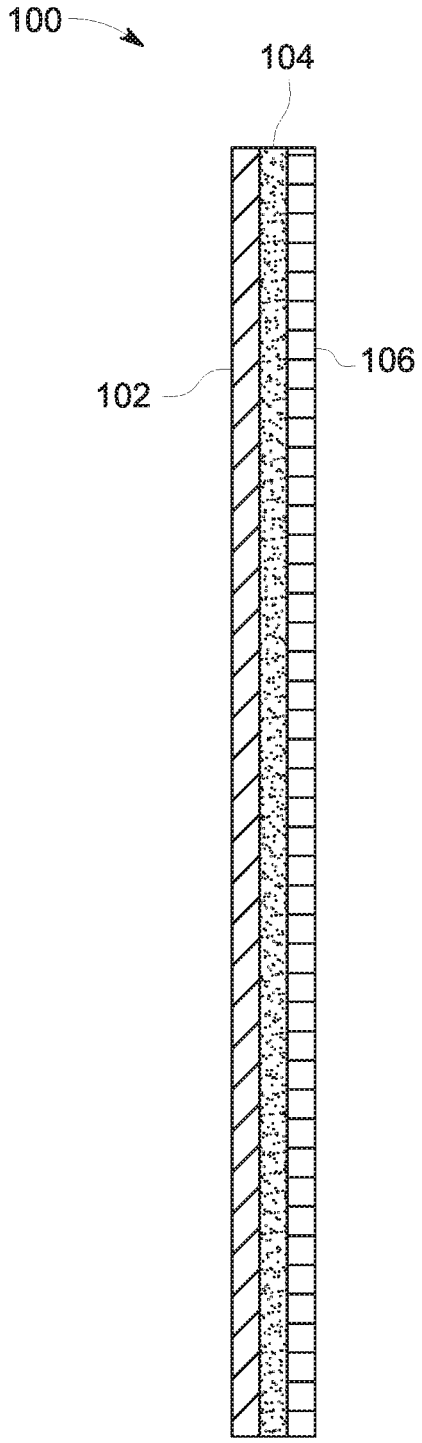
FIG. 1A illustrates a cross-sectional side view of a one-time wearable brassier for supporting and lifting sagging breast in accordance with a preferred embodiment of the present invention.

Further features and advantages of the present invention, as well as the structure and operation of various embodiments of the present invention, are described in detail below with reference to the accompanying drawings.

DETAILED DESCRIPTION OF DRAWINGS

While this technology is illustrated and described in a preferred embodiment, a one-time wearable brassiere for supporting and lifting sagging breasts may be produced in many different configurations forms, and materials. There is depicted in the drawings, and will herein be described in detail, as a preferred embodiment of the invention, with the understanding that the present disclosure is to be considered as an exemplification of the principles of the invention and the associated functional specifications for its construction and is not intended to limit the invention to the embodiment illustrated.

For purposes of the description hereinafter, the terms "upper", "lower", "right", "left", "vertical", "horizontal", "top", "bottom", "lateral", "longitudinal", and derivatives thereof shall relate to the invention as it is oriented in the drawings. It is also to be understood that the specific brassieres, breast support members, and methods of applying such illustrated in the attached drawings, and described in the following specification, are simply exemplary aspects of the disclosure. Hence, specific dimensions and other physical characteristics related to the aspects disclosed herein are not to be considered as limiting.

FIG. 1A illustrates a cross-sectional side view of a one-time wearable brassier 100 for supporting and lifting sagging breast in accordance with a preferred embodiment of the present invention. The one-time wearable brassier 100 includes a first layer 102, an adhesive layer 104, and a removable second layer 106.

The first layer 102 is explained in detail in conjunction with FIG. 1B, FIG. 2 to FIG. 6 of the present invention. The adhesive layer 104 includes adhesives that adheres the first layer 102 to the breast. The removable second layer 106 covers the adhesive layer 104. The removable second layer 106 protects the adhesives from drying until the user is ready to apply the first layer 102 along with the adhesive layer 104 to the breast.

In a preferred embodiment of the present invention, the removable second layer 106 is transparent or semi-transparent, highly flexible, stretchable, and (preferably) elastically recoverable. Further, the removable second layer 106 is made up of an elastomeric film formed of polyurethane. However, it would be readily apparent to those skilled in the art that various other material such as low molecular weight polyethylene or polyvinyl chloride, may be used to create the removable second layer 106 without deviating from the scope of the present invention.

Figure 1B:
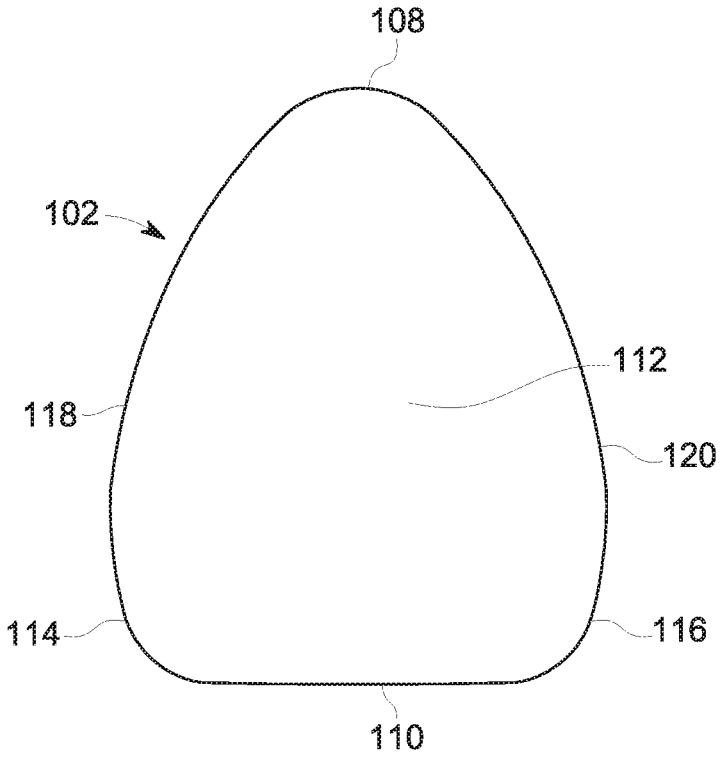
FIG. 1B illustrates a top view of a first layer for supporting and lifting sagging breast in accordance with a preferred embodiment of the present invention.

FIG. 1B illustrates a top view of the first layer 102 for supporting and lifting sagging breast in accordance with a preferred embodiment of the present invention. The first layer 102 is having a pear shaped stretchable woven fabric. The first layer 102 includes a curvy top end 108, a flat base 110, a central portion 112 to cover the breast, a curved left bottom edge 114, a curved right bottom edge 116, a tapered left side 118 extending from the curved left bottom edge 114 up to the curvy top end 108, and a right side 120 extending from the curved right bottom edge up 116 to the curvy top end 108.

The length of flat base 110 is greater than the curvy top end 108. The curved left bottom edge 114 and the tapered left side 118 are explained in detail in conjunction with FIG. 3 to FIG. 5 of the present invention.

Figure 2:
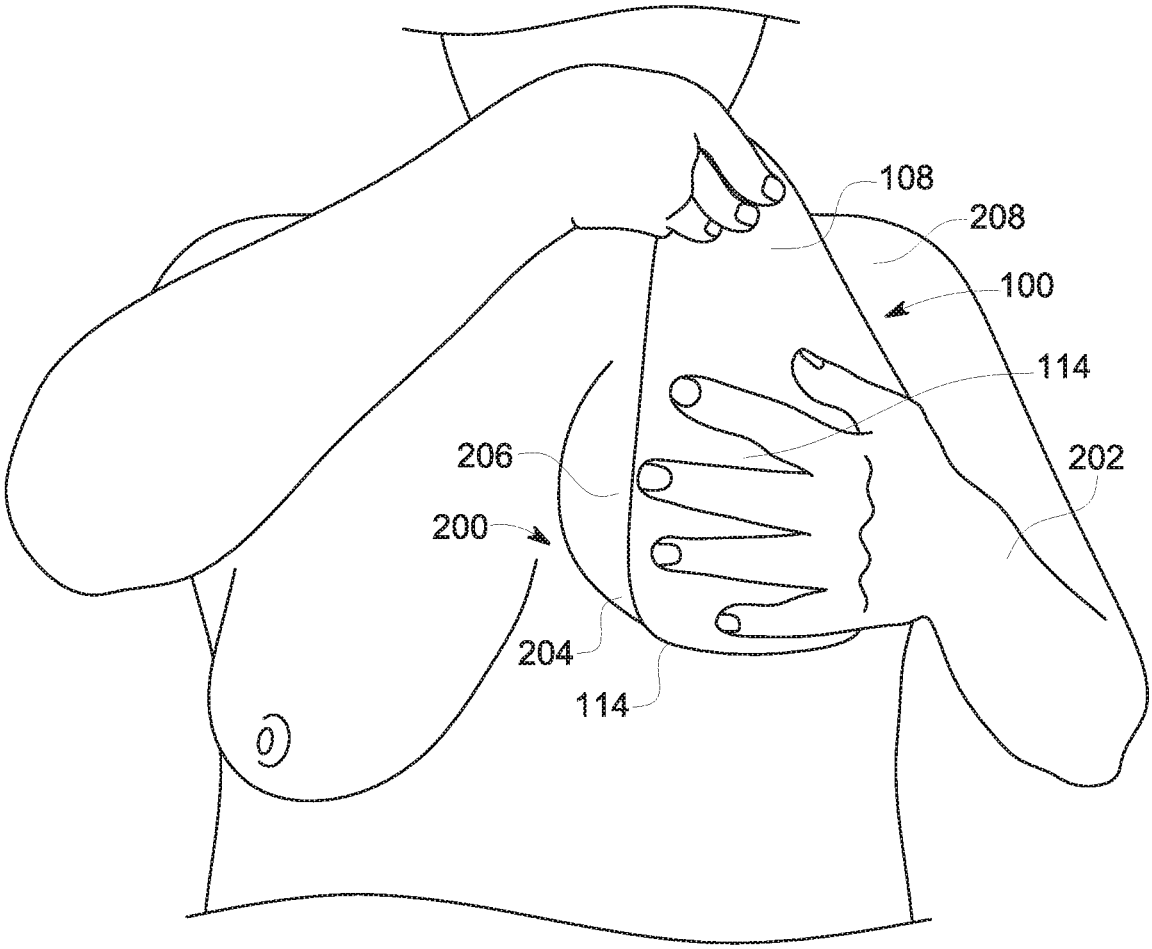
FIG. 2 illustrates a front view of pasting the one-time wearable brassiere on the breast in accordance with another preferred embodiment of the present invention.

FIG. 2 illustrates a front view of pasting the one-time wearable brassiere 100 on the breast 200 in accordance with another preferred embodiment of the present invention. A user 202 lifts the sagging breast 200 to paste the curved left bottom edge 114 beneath left edge 204 of the breast 200.

Similarly, the user 202 pastes the curved right bottom edge (116, shown in FIG. 6) beneath right edge of the breast 200. The user 202 then pastes the central portion 114 up to center 206 of the breast 200. Further, the user 202 stretches the curvy top end 108 up to chest 208 such that the central portion 114 covers the breast 200 while maintaining firmness of the breast 200 in upright position.

Figure 3:
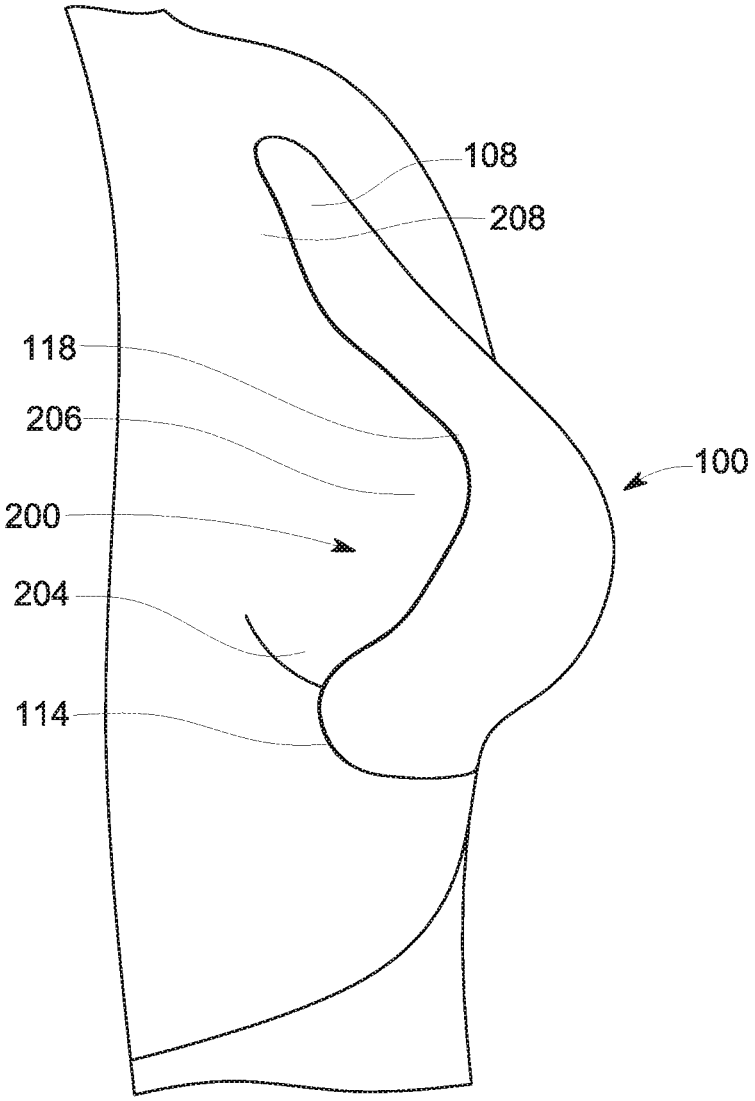
FIG. 3 illustrates a left side view of the one-time wearable brassiere pasted on the breast in accordance with another preferred embodiment of the present invention.

FIG. 3 illustrates a left side view of the one-time wearable brassiere 100 pasted on the breast 200 in accordance with another preferred embodiment of the present invention. The curved left bottom edge 114 is pasted beneath left edge 204 of the breast 200. The curved left bottom edge 114 is curved to cover and pushes the left edge 204 of the breast 200 towards the central portion 206 of the breast 200, thus maintaining the firmness of the breast 200.

The curved top surface 108 is pasted on the chest 208. However, it would be readily apparent to those skilled in the art that the curved top surface 108 may be pasted to any desired location on the user's body based upon the breast size and the type of dress without deviating from the scope of the present invention.

It would be readily apparent to those skilled in the art that the user 202 may paste the curved left bottom edge 114 in a way to show desired cleavage. The tapered left side 118 is tapered to allow the users to expose cleavage to desired length and width. The tapered left side 118 is tapered to allow users to wear dresses that show desired cleavage.

Figure 4:
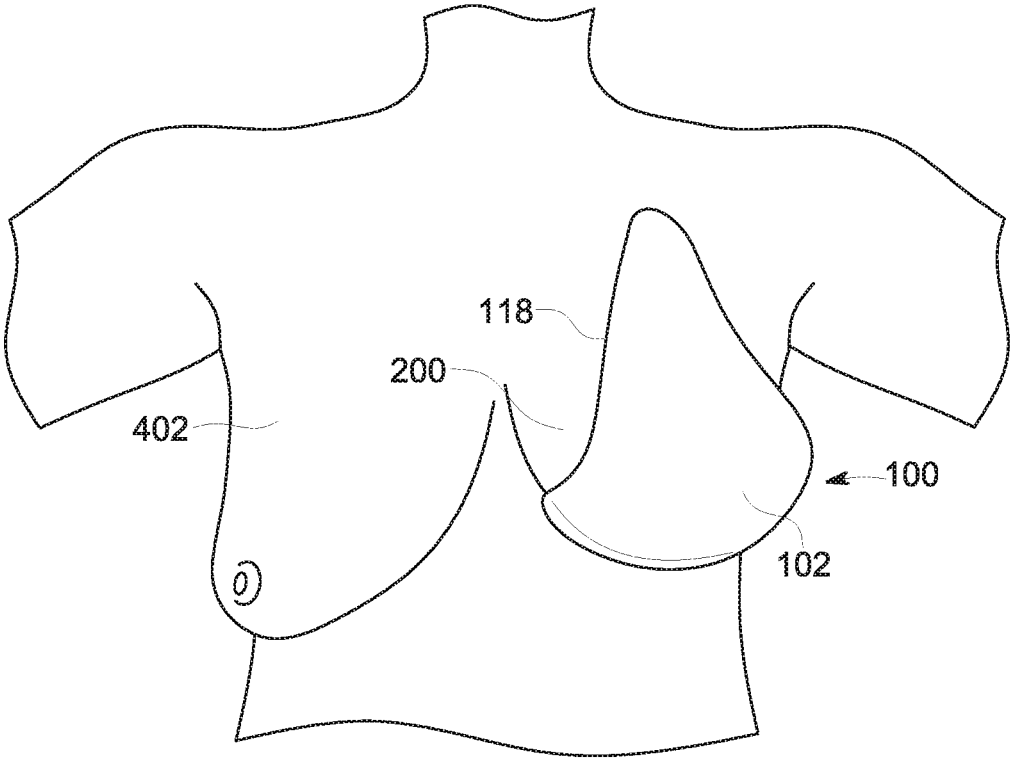
FIG. 4 illustrates a front view of the one-time wearable brassiere pasted on the breast to illustrate the difference between lifted breast and sagged breast.

FIG. 4 illustrates a front view of the one-time wearable brassiere 100 pasted on the breast to illustrate the difference between lifted breast and sagged breast. The tapered left side 118 allows the user to show the desired cleavage depending upon the requirement of the dress.

Further, the FIG. 4 shows the difference between the sagged breast 402 and the breast 200 lifted by the one-time wearable brassiere 100. The breast 200 is more firm in comparison to the breast 402. In a preferred embodiment of the present invention, the first layer 102 is made of cotton and elastic. Preferably, the cotton is 95% and elasticity is 5%.

The first layer 102 have elastic fibers and latex-free hypoallergenic cotton fiber tape with an acrylic heat-activated backing that stretches only along its longitudinal axis. The cotton fibers allow for evaporation and quicker drying leading to longer wear time. Furthermore, the first layer 102 is a Kinesiology Taping known to provide therapeutic effect by improving blood flow in the breast.

Figure 5:
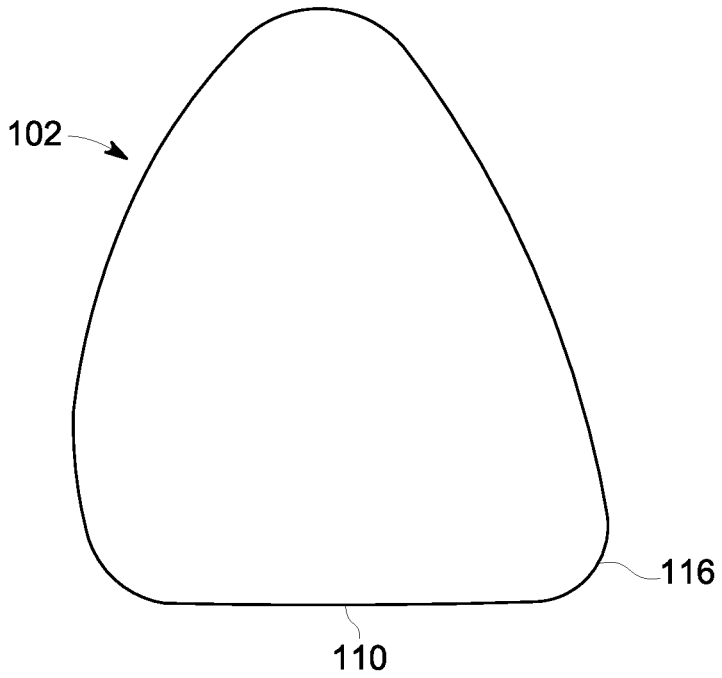
FIG. 5 illustrates a top view of the one-time wearable brassiere in accordance with another preferred embodiment of the present invention.

FIG. 5 illustrates a top view of the one-time wearable brassiere 100 in accordance with another preferred embodiment of the present invention. The curved right bottom edge 116 extends beyond the flat base 110. The extended curved right edge 116 is explained in detail in conjunction with FIG. 6 of the present invention.

Figure 6:
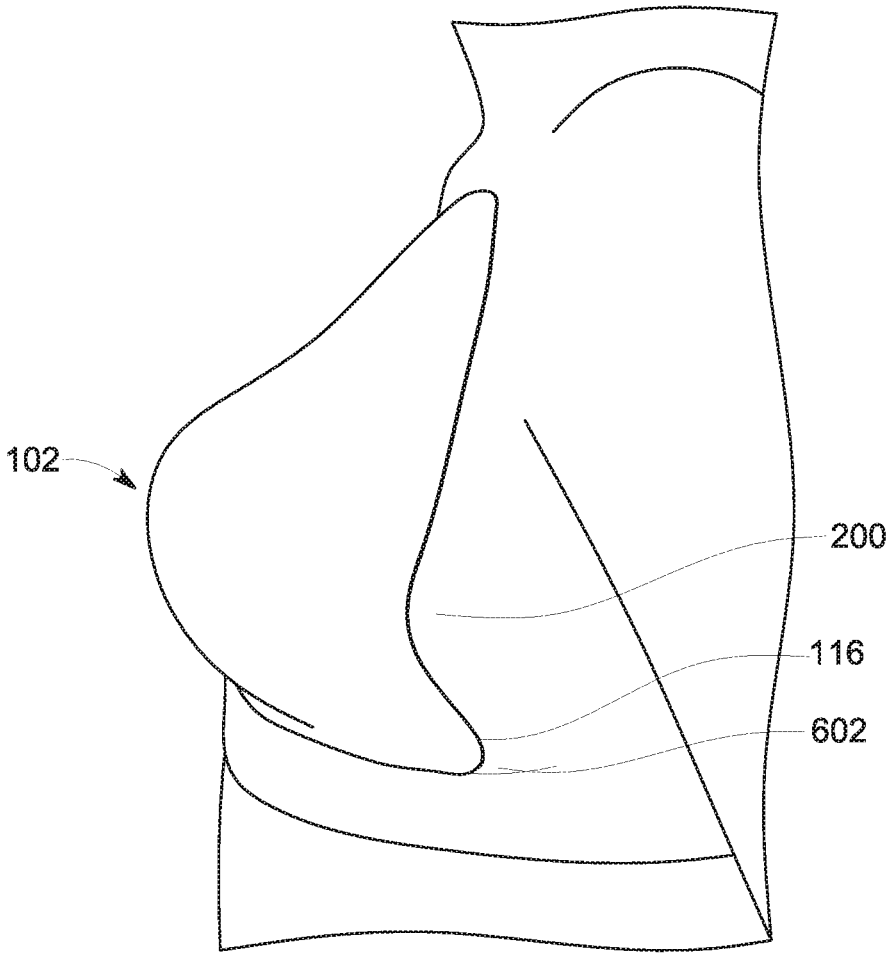
FIG. 6 illustrates another side view of the one-time wearable brassiere in accordance with another preferred embodiment of the present invention.

FIG. 6 illustrates another side view of the one-time wearable brassiere 100 in accordance with another preferred embodiment of the present invention. The extended curved right bottom edge 116 provides extra protection to push the sagging breast 200 from the right side to the central portion.

The user lifts the breast 200 from right side and pastes the curved right edge bottom edge 116 beneath right edge 602 of the breast 200. The extended curved right bottom edge 116 ensures that the breast 200 does not falls from the right. The extended curved right bottom edge 116 of the one-time wearable brassiere 100 ensures that breast 200 does not sag and corrects the shape by moving to breast 200 from right side to the central portion.

The present invention offers various advantages such as weightless brassiere. The one-time wearable brassiere molds according to the shape of the breast and thus maintains the required shape. The one-time wearable brassiere further provides extended support without the usage of straps, cups, wire or bands. Furthermore, the present invention allows a girl to wear most type of dresses without worrying about the straps and shape of the breast.

The above described embodiments should be regarded as illustrative rather than restrictive. Accordingly, it should be appreciated that variations to those embodiments may be made by those skilled in the art without departing from the scope of the invention as defined by the following claims.

The invention claimed is:

1. A one-time wearable brassier for supporting and lifting sagging breast of a user, the one-time wearable brassier comprising:

a first layer having a pear shaped stretchable woven fabric, the first layer having a curvy top end, a flat base, a central portion to cover the breast, a curved left bottom edge, a curved right bottom edge, a tapered left side extending from the curved left bottom edge up to the curvy top end, and a right side extending from the curved right bottom edge up to the curvy top end, wherein a length of the flat base is greater than a length of the curvy top end;

an adhesive layer comprising adhesives adhered the first layer to the breast; and a removable second layer covers the adhesive layer; further the removable second layer protects the adhesive from drying until the user is ready to apply the first layer along with the adhesive layer to the breast;

wherein the user lifts the sagging breast to paste the curved left bottom edge beneath a left edge of the breast and further pastes the curved right bottom edge beneath a right edge of the breast; further the user pastes a central portion of the first layer up to a center of the breast; and further the user stretches the curvy top end of the first layer up to chest such that the central portion covers the breast while maintaining a firmness of the breast in an upright position; and wherein a height of the tapered left side and a height of the right side are both greater than the width of the length of the flat base and a width of the curvy top end; and wherein the flat base is flat from the end of the curved left bottom edge to the curved right bottom edge for a length that is greater than fifty percent of the width of the one-time wearable brassier before the one-time wearable brassier is stretched.

2. The one-time wearable brassiere element according to claim 1 wherein the first layer is made of cotton and elastic.

3. The one-time wearable element according to claim 1 wherein the adhesive layer is acrylic coating.

4. The one-time wearable brassiere according to claim 1 wherein the curved right bottom edge extends beyond the flat base.

5. The one-time wearable brassiere according to claim 4 wherein when the user lifts the sag breasts to the center, then the curved right bottom edge supports the position of the breasts in the center.

6. The one-time wearable brassiere according to claim 1 wherein the user pastes the left curved bottom edge beneath the left corner of the breast and further pastes the central portion in a way to show a desired cleavage.

7. A one-time wearable brassier for supporting and lifting sagging breast of a user, the one-time wearable brassier comprising:

a first layer having a pear shaped stretchable woven fabric, the first layer having a curvy top end, a flat base, a central portion to cover the breast, a curved left bottom edge, a curved right bottom edge, a tapered left side extending from the curved left bottom edge up to the curvy top end, and a right side extending from the curved right bottom edge up to the curvy top end, wherein a length of the flat base is greater than a length of the curvy top end, for a length that is greater than fifty percent of the width of the one-time wearable brassier before the one-time wearable brassier is stretched;

an adhesive layer comprising adhesives adhered the first layer to the breast; and a removable second layer covers the adhesive layer; further the removable second layer protects the adhesive from drying until the user is ready to apply the first layer along with the adhesive layer to the breast;

wherein the user lifts the sagging breast to paste the curved left bottom edge beneath a left edge of the breast and further pastes the curved right bottom edge beneath a right edge of the breast; further the user pastes a central portion of the first layer up to a center of the breast; and further the user stretches the curvy top end of the first layer up to chest such that the central portion covers the breast while maintaining a firmness of the breast in an upright position; and wherein a height of the tapered left side and a height of the right side are both greater than the width of the length of the flat base and a width of the curvy top end;

wherein the flat base is flat from the end of the curved left bottom edge to the curved right bottom edge for a length that is greater than fifty percent of the width of the one-time wearable brassier before the one-time wearable brassier is stretched; and wherein the first layer comprises an elastic fiber and latex-free hypoallergenic cotton fiber tape with an acrylic heat-activated backing that stretches only along its longitudinal axis.

* * * * *